US006318928B1

(12) United States Patent
Swearingen

(10) Patent No.: US 6,318,928 B1
(45) Date of Patent: Nov. 20, 2001

(54) METHOD AND APPARATUS FOR ELECTRICALLY HEATING A SCREED ASSEMBLY IN A PAVING MACHINE

(75) Inventor: David Swearingen, Ooltewah, TN (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 09/479,167

(22) Filed: Jan. 7, 2000

(51) Int. Cl.[7] ..... E01C 23/14; E01C 19/22
(52) U.S. Cl. ..... 404/72; 404/95
(58) Field of Search ..... 404/72, 86, 95, 404/118, 79

(56) References Cited

U.S. PATENT DOCUMENTS

| | | | | |
|---|---|---|---|---|
| 4,319,856 | | 3/1982 | Jeppson | 404/79 |
| 5,259,693 | | 11/1993 | Raymond | 404/95 |
| 5,397,199 | * | 3/1995 | Frampton et al. | 404/118 |
| 5,417,516 | | 5/1995 | Birtchet | 404/71 |
| 6,124,580 | * | 9/2000 | Nottmeier et al. | 219/635 |

* cited by examiner

*Primary Examiner*—Thomas B. Will
*Assistant Examiner*—Gary S. Hartmann
(74) *Attorney, Agent, or Firm*—Nilles & Nilles SC

(57) ABSTRACT

A paving machine employs an electrically heated screed assembly to uniformly heat a screed plate of the machine. Uniform heating is achieved by inserting a thermally conductive plate between electrical heating elements and the screed plate. An insulation layer may be provided above the heating elements to direct the heat downward into the thermally conductive plate. The heat spreads relatively uniformly throughout the thermally conductive plate, thereby uniformly heating the screed plate. A clamping mechanism is also provided that, when tightened, provides a compressive force, thereby holding the assembly in place. When released, the pressure is alleviated, thus permitting a heating element to be removed for repair or replacement without the need to remove the screed plate.

27 Claims, 10 Drawing Sheets

METHOD AND APPARATUS FOR ELECTRICALLY HEATING A SCREED ASSEMBLY IN A PAVING MACHINE

BACKGROUND OF THE INVENTION

1. Field of the Invention

The invention relates to paving machines and, more particularly, relates to an improved method and apparatus for uniformly heating a screed plate of a paving machine by providing a conductive plate between an electrical heating element and the screed plate, and for providing a clamping mechanism that permits the electrical heating element to be easily replaced without the need to remove the screed plate.

2. Discussion of the Related Art

Paving machines are well known for working paving materials into a mat to produce roads and other paved structures. Specifically, the typical paving machine transports paving materials from a hopper along a conveyor system and ultimately to a distributing auger, where the paving materials are distributed onto a roadway or another surface, where a screed plate then paves the paving materials into a mat. While the paving materials could be any of various known materials, hot mix asphalt (HMA) is commonly used and, for the sake of convenience, the paving materials will hereinafter be referred to as HMA.

The screed plates of HMA paving machines are typically preheated to a temperature of about 200° F. to 300° F. before paving commences and are maintained at this temperature during paving to prevent the hot asphalt being leveled by the screed plate from congealing on the face of the screed plate. Screed plates have traditionally been heated by oil or gas burners mounted above the screed plate such that the flames from the burners impinge sheet metal plates on top of the screed plate. Such burners supply intense heat to localized portions of the screed plates which results in uneven heating and congealing of the HMA onto the screed plate. Additionally, if the process is not carefully controlled, the screed plate may warp and become ineffective. Furthermore, as the flames become progressively dirtier, noxious fumes are emitted for the operator to contend with.

Systems have been proposed which are designed to avoid or to at least alleviate some of the problems associated with traditional screed heaters. In one such system, a heater heats the screed plate of a paving machine via heat transfer from heating oil stored in a low pressure reservoir mounted directly on top of the screed plate. Oil in the reservoir is drawn from the reservoir, pressurized by a high pressure pump, and then fed through a pressure release valve or other suitable flow restrictor which creates a pressure drop in the range of about 700 to 800 psi, thereby heating the oil to a temperature of about 275° F. The thus-heated oil is then returned to the reservoir for heat transfer to the screed plate.

This heated oil system suffers from several drawbacks and disadvantages. Most notably, the large pressure drops needed to provide the necessary heating require that the heating oil be pressurized by a pump to a relatively high pressure in the range of 800 to 1000 psi before undergoing the pressure drop in the flow restrictor. This requires the use of high pressure hoses and connections throughout the system, thus increasing the cost and complexity of the system and also increasing the dangers of leaks which could render the system ineffective. Moreover, if for any reason the pump and relief valve are not capable of providing a sufficiently large pressure drop to adequately heat the oil, the system then becomes incapable of boosting the oil temperature to the required level.

It therefore became desirable to develop a screed plate heating system that involves no moving parts, runs clean, emits no noxious fumes, and is capable of uniformly heating the screed plate.

One known system that strives to meet at least some of these goals involves the installation of electrical heating elements that are in direct contact with the screed plate to heat the screed plate. Being electrically powered by a sufficiently sized generator, this system does not have the disadvantages associated with combustion, and also ensures that sufficient energy is supplied to the electrical heating elements so that the screed is adequately heated. Furthermore, the generators associated with the electrically heated systems allow the use of higher-wattage lights than the conventional twelve-volt lights used on traditional paving machines, thus facilitating night operation. However, the direct contact between the heating elements and the screed plate gives rise to heat distribution problems similar to those encountered by oil-heated screeds. Specifically, hot spots develop on the screed plate at the point where the heating element contacts the screed plate, and the screed plate cools progressively at points more distant from the contact. This uneven heat distribution can also lead to relatively high temperature gradients, and possible warping of the screed plate. Another disadvantage arises when the electrical heating elements require either repair or replacement. In order to remove a heating element from this system, the screed plate must first be removed before an operator is able to access the heating element. This removal requirement is very time consuming and labor intensive.

The need has therefore arisen to provide an electrically heated screed assembly, which is capable of uniformly heating the screed plate while allowing easy access to and replacement of the heating elements without having to remove the screed plate.

OBJECTS AND SUMMARY OF THE INVENTION

It is therefore a first object of the invention to provide an electrically heated screed assembly for a paving machine that heats the screed plate uniformly, thus preventing both paving material congealing and screed warping.

A second object of the invention is to develop an electrically heated screed assembly that allows for easy removal of the heating elements of the assembly for repair or replacement without having to remove the screed plate or otherwise disassemble the screed assembly.

A third object of the invention is to develop an electrically heated screed assembly that has one or more of the aforementioned advantages and that is extendible to widen the screed assembly, thus permitting paving of a wider area.

In accordance with a first aspect of the invention, a subframe attaches to the frame of the screed assembly. A screed plate is mounted onto the bottom of the subframe and a thermally conductive plate, such as aluminum, is disposed adjacent to the screed plate in a manner so as to span the length of the screed plate to a point just short of the midpoint of the screed plate's length. An electrical heating element, which may comprise a metallic material having a resistive coil wound inside it, is placed onto the thermally conductive plate. The heating element is wired to a power generator which supplies energy to the coil, thus heating the heating element. The thermally conductive plate then becomes uniformly heated and supplies this heat to the screed plate. The thermally conductive plate therefore effectively acts as a heating element and, because it is in thermal contact with a substantial area of the screed plate, it operates to heat the screed plate uniformly. An insulation layer may be placed above the electrical heating element to maximize the percentage of generated heat that is directed downwards toward the conductive plate and screed plate. Several electrical heating elements may be placed in strategic locations throughout the screed plate. To permit the screed plate to crown during operation, the heating elements and conductive plate preferably do not span the entire length of the screed plate. They instead span to a point short of the midpoint of the screed plate's length, and a complimentary assembly is located on the other side of the screed so as to also span to a point just short of the midpoint of the screed plate. Several rows of heating elements may be installed so that the entire screed plate is sufficiently heated.

In accordance with a second aspect of the invention, a clamping mechanism is installed on the heating element that, when tightened, compresses the associated heating element against the screed plate. When the clamping mechanism is loosened, the compressive force is relieved from the heating element, thus permitting an electrical heating element to be removed by an operator simply by pulling it in a longitudinal direction away from the screed assembly without first having to remove the screed plate. A new or repaired heating element may then be inserted into the system before re-tightening the clamping mechanism.

In a preferred embodiment, the clamping mechanism comprises a tubular beam that is placed above the insulation or, alternatively, directly above the heating element. A bracket is mounted on top of the beam and a vertical hole is created in the bracket's upper horizontal surface. Likewise, a vertical hole is formed in the upper horizontal surface of the subframe. The subframe hole is aligned with the hole in the bracket so that a bolt or other suitable threaded fastener may be inserted into both holes.

In one embodiment of the invention, the hole through the subframe surface is tapped and threadedly engages the bolt threads.

In another embodiment, a first nut is mounted on the subframe's upper horizontal surface, and the bolt is inserted into both holes. A second nut is mounted onto the bolt at a point located between the hole in the bracket and the beam. Therefore, when the bolt is tightened, the beam is lowered and provides a compressive force on the screed assembly. Conversely, when the bolt is loosened, the second nut exerts an upward force on the bracket, thus raising the beam and relieving the compressive force. The tapped hole through the subframe surface, mentioned above and preferred, achieves the same effect.

Additionally, a series of pusher bolts may be added to the clamping mechanism, that extend through the upper horizontal surface and contact the beam to provide uniform pressure throughout the screed assembly.

In accordance with a third aspect of the invention, an extension is provided that can be attached to the pre-existing screed assembly. Specifically, the extension includes a subframe having a vertical wall that is bolted onto a vertical wall of the frame of the paving machine. The extension also includes an electrical heating element and a thermally conductive plate, as well as the aforementioned clamping mechanism. This is particularly useful when an operator needs to pave a wider surface than usual.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

Pursuant to the invention, a paving machine is provided which employs an electrically heated screed assembly including a screed plate and electrical heating elements that are in contact with a thermally conductive plate which is in contact with the screed plate. In this manner, the screed plate is uniformly heated. Clamping mechanisms are also installed in the screed assembly which, when loosened, allow for easy removal and replacement of the electrical heating elements without removing the screed plate. When tightened, the clamping mechanisms supply a compressive force to the heating elements, thereby preventing removal of the heating elements in the tightened state.

Figure 1:
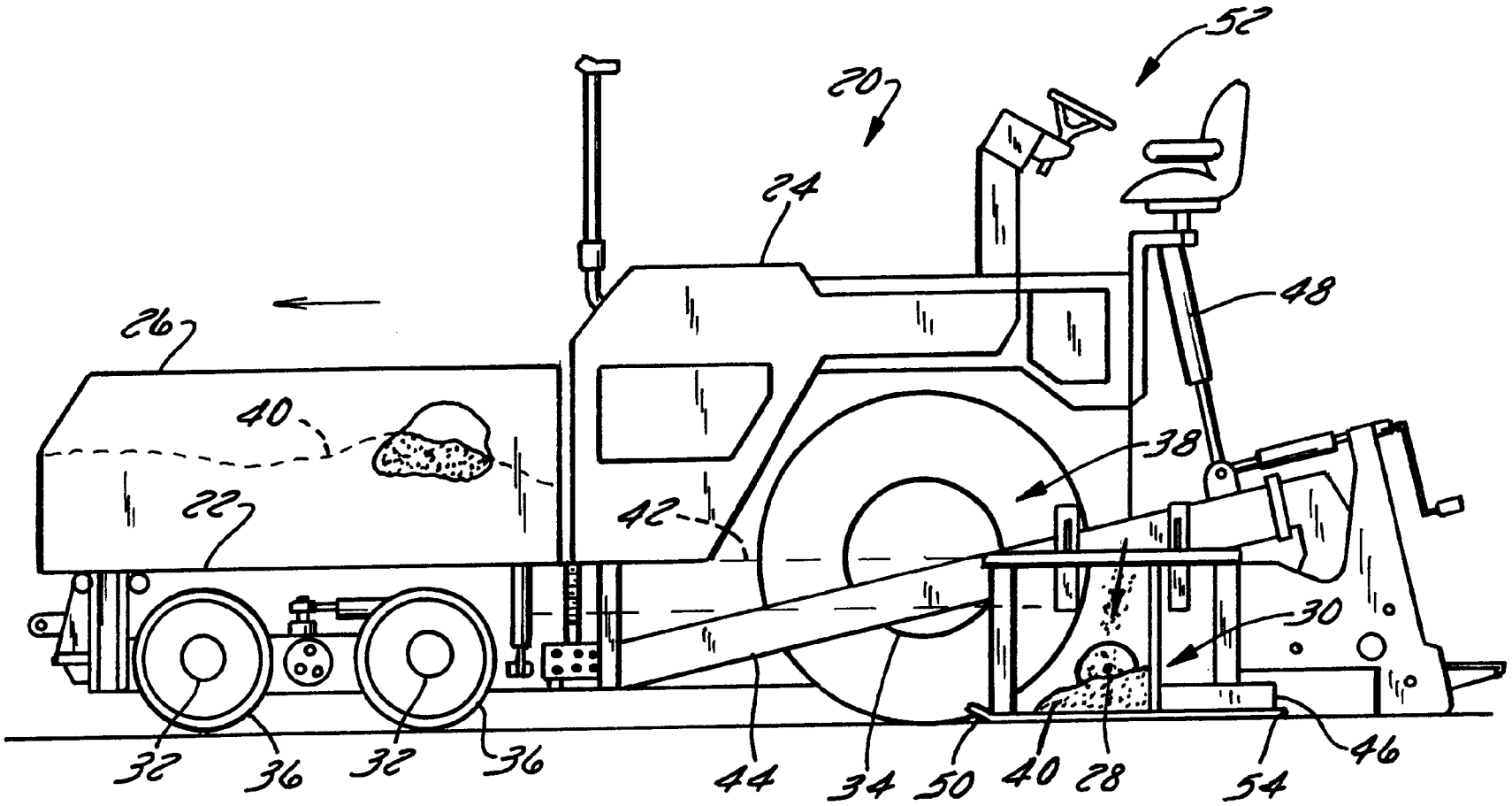
FIG. 1 is a side elevation view of a paving machine that incorporates an electrically heated screed assembly constructed in accordance with a preferred embodiment of the present invention.

Referring to the drawings and initially to FIG. 1 in particular, a paving machine 20 is illustrated that includes a self-propelled chassis 22 on which is mounted an engine 24; a hopper 26; and a paving apparatus including a distributing auger mechanism 28 and a screed assembly 30. The chassis 22 is mounted on two front axles 32 and rear axle 34, receiving front steering wheels 36 and rear driving wheels 38, respectively. The front 32 and rear 34 axles are steered and powered hydrostatically by engine 24 in a known maimer.

The hopper 26 preferably has a total capacity of about twelve tons to conform with industry standards and is designed to receive the paving materials 40 and to temporarily store them pending their delivery to the paving apparatus. While the paving materials 40 may comprise any known material, HMA is typically used and, for the sake of convenience, the paving materials 40 will hereinafter be referred to as HMA. A conveyor assembly 42 transports the HMA from a rear discharge opening of the hopper 26 to the auger mechanism 28 of the paving apparatus.

The distributing auger mechanism 28 of the paving apparatus may be any conventional mechanism and, in the illustrated embodiment, is of the type employed by the paving machine manufactured by Roadtec of Chattanooga, Tenn. under the Model No. RP 180-10. The distributing auger mechanism 28 thus includes a hydrostatically driven bolt-type distributing auger extending transversely across the chassis 22 and mounted on a slide (not shown) which is raiseable and lowerable with respect to a stationary frame.

The screed assembly 30 comprises a pair of transversely spaced apart tow arms 44 (only one of which is shown in FIG. 1), and a heated (and preferably vibratory) screed plate 46 pivotally suspended from the rear ends of the tow arms 44. Each tow arm 44 is raiseable and lowerable with respect to the chassis 22 at its front end via a first hydraulic cylinder (not shown) and at its rear end via a second hydraulic cylinder 48. The front of each of the tow arms 44 is also pivotally connected to the chassis 22 at a tow point, formed from a bracket assembly, so as to permit vertical adjustment of the screed assembly 30 using the hydraulic cylinders mentioned.

In operation, the paving machine 20 is positioned on the surface to be paved 50, and the hopper 26 is filled with the preferred paving material 40, HMA. The conveyor assembly 42 then is activated to transport the HMA to the paving apparatus. An operator (not shown), when seated at a station or console 52, then controls the engine 24 to propel the paving machine forward, in the direction of the arrow shown in FIG. 1. Paving is commenced by discharging HMA 40 from the hopper 26 to the distributing auger 28, which then remixes and distributes the HMA 40. The screed assembly 30 then works the HMA into a mat 54 on the paving surface 50.

Figure 2:
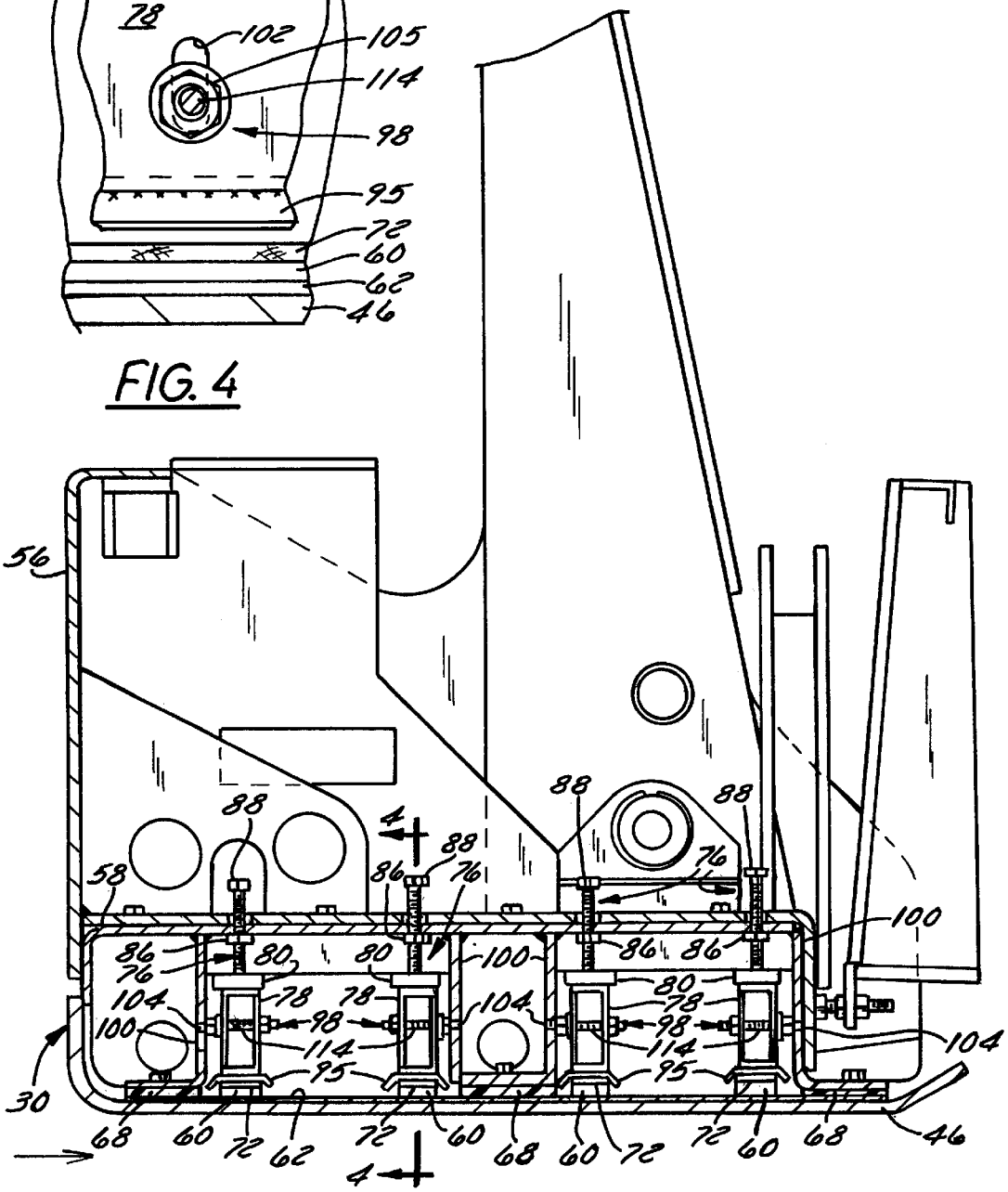
FIG. 2 is a sectional side elevation view of the screed assembly of the paving machine of FIG. 1, on an enlarged scale relative thereto.

Referring now also to FIG. 2, the screed assembly 30 further includes a main frame 56 and a subframe 58 mounted on the bottom of the main frame 56. A screed plate 46 is then mounted on the bottom of the subframe 58, thereby providing the foundation for the installation of the heating elements 60. The screed plate 46 is covered by, and is in direct contact and thermal communication with, a thermally conductive plate 62. The thermally conductive plate 62 is in thermal communication with the screed plate 46, preferably by direct contact. In the present embodiment, the thermally conductive plate 62 is formed from aluminum, but it should be noted that any suitable thermally conductive material would suffice.

Figure 5:
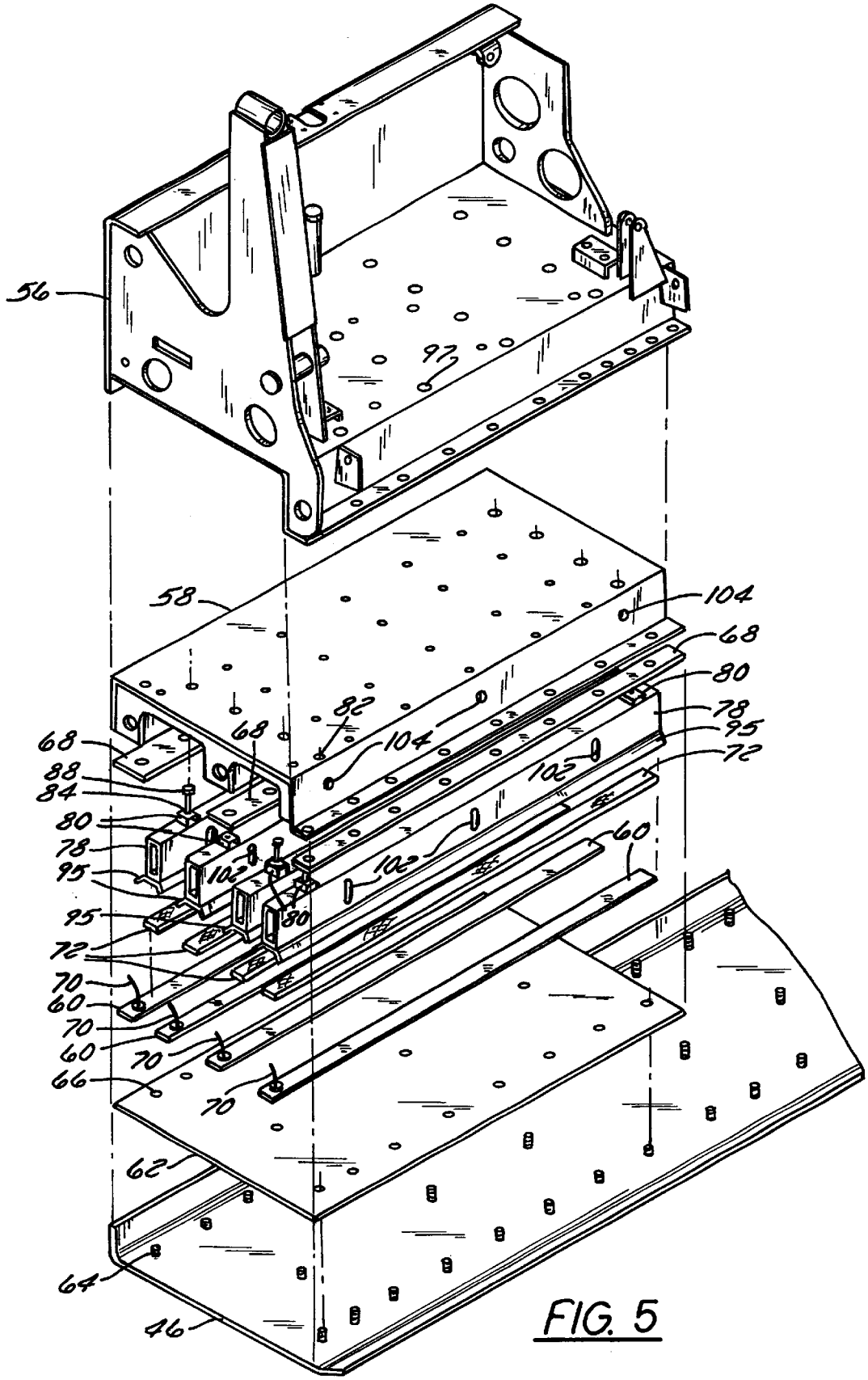
FIG. 5 is an exploded perspective assembly view of the screed assembly.

Turning next to FIG. 5, it will be noted, when the thermally conductive plate 62 is placed onto the screed plate 46, that studs 64 in the screed plate 46 are able to extend through corresponding holes 66 in the thermally conductive plate 62, enabling the plates 62 and 46 to be fixed to the subframe 58. This manner of assembly not only fixes the thermally conductive plate 62 to subframe 58 but also prevents relative movement with respect to the screed plate 46. A plurality of heating elements 60 are disposed directly above the thermally conductive plate 62, and an additional insulation layer 68 is disposed between the subframe 58 and the conductive plate 62. Each heating element 60 is held in place by a dedicated clamping mechanism 74, as is shown in FIG. 8.

Referring back to FIG. 2, the several illustrated electrical heating elements 60 are shown as being arranged in four rows of laterally-disposed heating elements 60, so spaced longitudinally relative to the front and back of the paving, machine 20 (FIG. 1) as to effectively span the width and a major portion of the length of the screed plate 46.

Figure 3:
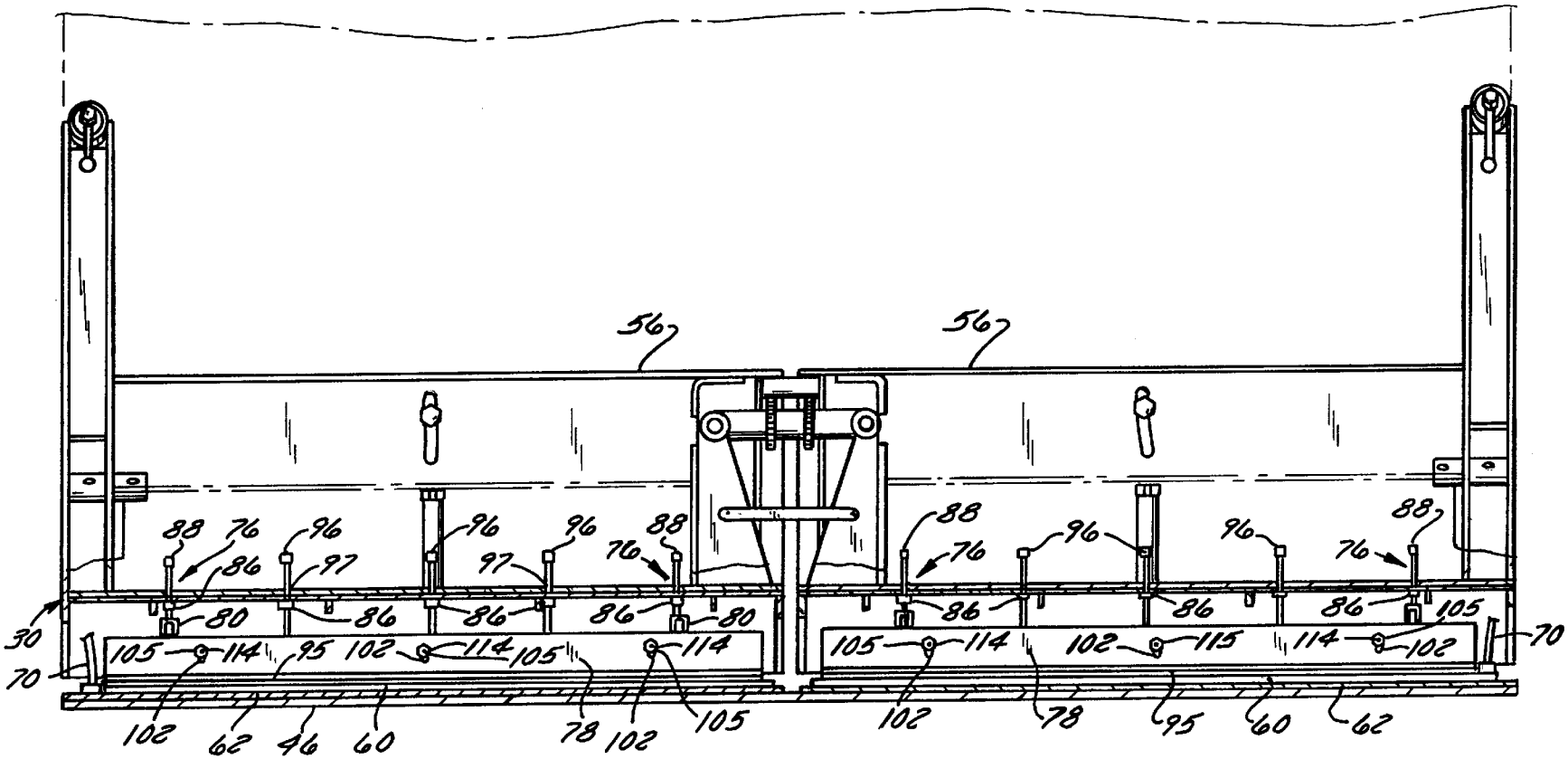
FIG. 3 is a sectional rear elevation view of the screed assembly with the exterior frame removed.
Figure 8:
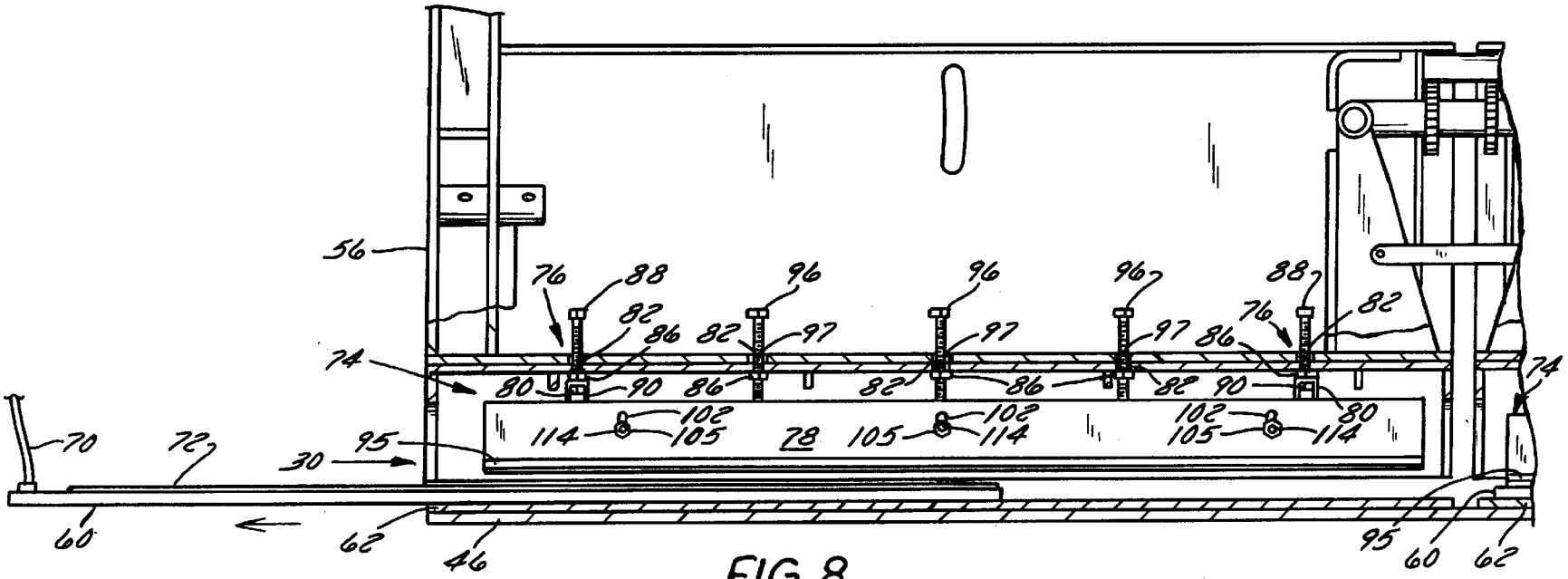
FIG. 8 is a sectional end elevation view of a portion of the screed assembly, taken along the plane 8—8 in FIG. 7 and on a slightly reduced scale relative thereto.

As shown in FIGS. 3 and 8, each row of heating elements includes two electrical heating elements 60, disposed on opposite lateral sides of the screed plate 46, in a known maimer, to form a gap midway along the length of the screed plate 46, thereby allowing the screed plate 46 to crown during operation. Of course, the number and location of heating elements 60 may vary depending on, for example, the size of the screed plate 46.

In this embodiment, each heating element 60 comprises a rigid hollow bar of steel or another metallic material having a resistive coil wound inside it that heats when energized, as is well known in the art. The heating element is wired to an electric generator (not shown) by lead wires 70 (shown in FIGS. 3 and 8) in a known, conventional manner to supply energy to the coil. The generator also provides additional power for high voltage lighting, thus facilitating night operation. An insulation layer 72 (shown in FIGS. 7 and 8) is disposed directly above the electrical heating elements 60 to inhibit heat transfer to the associated clamping mechanisms 74 (detailed below), thereby maximizing the transfer of energy downwards toward the thermally conductive plate 62 and screed plate 46, thus increasing the efficiency of the system. While the insulation layers 68 and 72 are not essential for the operation of the present invention, their nonuse will decrease the efficiency of the system. It must also be noted that the thermally conductive plate 62 is not necessary to comply with all aspects of the invention, but it is implemented in this embodiment to supply heat uniformly to the screed plate 46. If the thermally conductive plate is not used, the electrical heating elements 60 will be in direct contact with the screed plate 46, and a higher number of more closely spaced heating elements would likely be employed.

Figure 7:
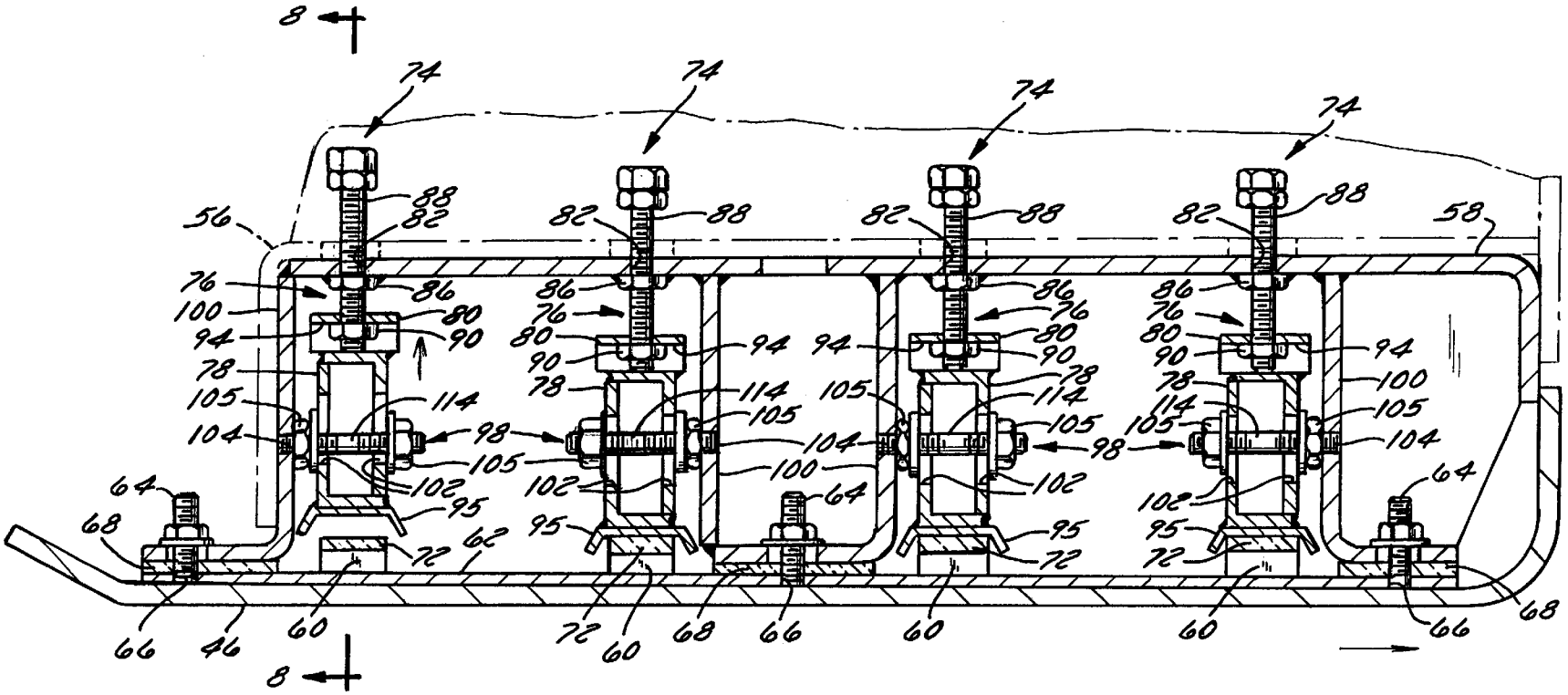
FIG. 7 is a sectional side view of a portion of the heated screed assembly, on an enlarged scale relative to FIG. 2.

Turning next to FIGS. 7 and 8, each clamping mechanism 74 is seen to include a pair of clamps 76 located at both ends of a tubular beam 78, which is mounted above the insulation layer 72. Mounted directly to the underside surface of the beam 78 is a bent plate 95 that is designed to captively retain the insulating layer 72 and electrical heating element 60 relative to conductive plate 62 when the clamps 76 are tightened.

As shown in FIG. 7, one such clamp 76 can be used to pull the beam 78 upwardly (as depicted by the arrow) away from the heating elements 60, when loosened, thereby allowing the heating elements 60 to be easily removed from the paving machine, as desired, without first removing the screed plate 46.

As shown in FIGS. 2–4 and 7, the clamps 76 are seen to exert a downward force on the beam 78 when tightened, thereby providing a compressive force to the associated heating element 60. Each clamp 76 preferably includes a bracket 80 that is welded to or otherwise mounted on beam 78. Both the subframe 58 and bracket 80 (FIGS. 2 and 4) comprise horizontal surfaces 92, 94, respectively, shown in FIG. 4, in which aligned holes 82, 84 exist, respectively, as shown in FIGS. 5 and 7.

Figure 4:
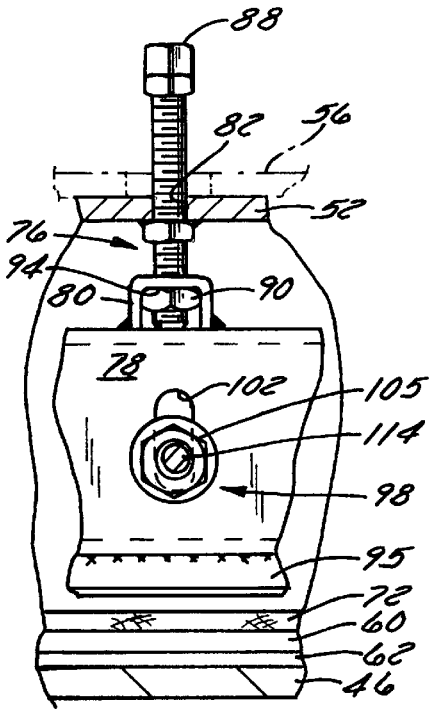
FIG. 4 is a fragmentary sectional side elevation view of one of the clamping mechanisms of the screed assembly with a cutaway portion of the frame, taken along the plane 4—4 in FIG. 2 and on an enlarged scale relative thereto.

In the illustrated embodiment of FIG. 4, a nut 86 is shown as welded to or otherwise mounted on the underside of the hole 82 in the subframe 58. To achieve the same effect, the illustrated hole 82 may be tapped in a known manner to form a threaded hole through the upper surface of subframe 58.

As shown in FIG. 4, a bolt 88 is inserted through the hole 82 in the subframe 58 and accompanying nut 86 and is further inserted through the hole 84 in the bracket 80. If holes 82 of the subframe 58 are tapped, as noted above, the nuts 86 will not be necessary if the threads of hole 82 mesh with the threads of bolt 88.

Once the bolt 88 is inserted into the bracket 80, a nut 90 is mounted onto the bolt 88 at a point between the bracket 80 and the beam 78. As shown in FIGS. 4 and 7, the bolt 88 may then be tightened relative to subframe 58 until such bolt 88 buttresses up against beam 78. After that, a nut 90, threadedly engaging bolt 88 between surface 94 and tubular beam 78 (as shown in FIG. 4), may be raised along the bolt 88 until such nut 90 is closely adjacent the underside of the horizontal surface 94 of the bracket 80, after which such may then be fixed to the bolt 88 using a spring pin (not shown) or any other known method of fastening.

In this manner, when clamp 76 is tightened, the downward movement of each beam 78 provides a compressive force to associated heating elements 60. Conversely, when the clamp 76 is loosened, the nut 90 exerts an upwards force on the bracket 80, thus raising the beam 78 away from the associated electrical heating element 60. Once the beam 78 is raised, the electrical heating element 60 can be removed by sliding it in a longitudinal direction that is generally parallel to the beam 78 until it is free from the system, as shown in FIG. 8. A second electrical heating element may then be installed by sliding it into the system in a direction generally parallel to the beam 78. Alternatively, the electrical heating element 60 may be repaired and reinstalled into the assembly 30. Note that the screed plate 46 is not removed during this process. Referring to FIG. 7, the clamping mechanism 74 on the left is shown in the open position while the remaining clamping mechanisms 74 are shown to be tightened.

Figure 6:
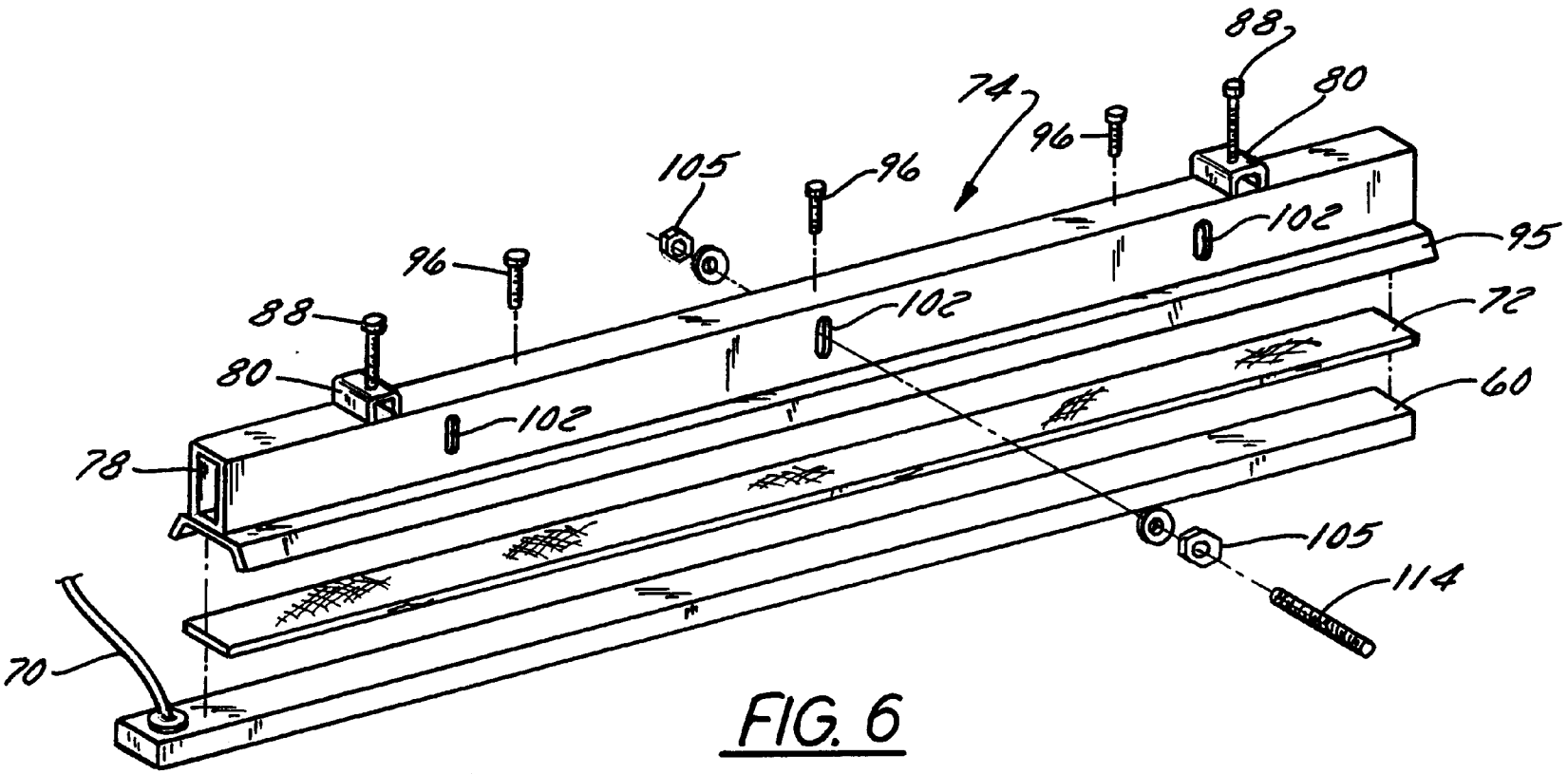
FIG. 6 is an exploded perspective view of one of the heating elements and the associated clamping mechanism of the screed assembly.

Referring to FIGS. 6 and 8 optional pusher bolts 96 are installed at spaced-apart locations longitudinally between the clamps 76 in accordance with the preferred embodiment of the invention. These pusher bolts 96 function to provide uniform compression to the beam 78 if the beam 78 is sufficiently long that the clamps 76 alone might not adequately compress the heating elements 60. The number of necessary pusher bolts 96 is indicative of the length of the associated beam 78. Thus, if the beam 78 is sufficiently short, no pusher bolts 96 will be necessary. If necessary, one such pusher bolt 96 can be installed by drilling a vertical hole 97 in the subframe 58. Preferably, the hole 97 is tapped in a known manner so as to have threads that mesh with the threads of pusher bolt 96. As still another an alternative embodiment, nut 86 may be welded to or otherwise mounted on the underside surface of subframe 58. In the illustrated alternative embodiment, the pusher bolt 96 is shown to be inserted through the hole 97, threaded through the nut 86 and, when tightened, buttressed up against the beam 78. Further tightening of the pusher bolts 96 compresses the associated electrical heating element 60, thereby holding the heating element 60. Note that if the pusher bolts 96 are installed, they are first loosened before the clamps 76 are raised.

Lateral clamps 98, best seen in FIGS. 2, 4 and 6–8, are also integrated into each clamping mechanism 74 (FIGS. 6 and 7) to prevent the clamping mechanism 74 from collapsing while the bolts 88 and 96 are tightened against the beam 78. Otherwise, the compressive force from clamp 76 and pusher bolts 96 could cause the base of beam 78 to slip out from underneath of the screed assembly 30. Each lateral clamp mechanism 98 is seen to include: 1) a hole 104 (FIGS. 2 and 7) in a vertical surface 100 of subframe 58; 2) vertical slots 102 (FIG. 6) in the side walls of the beam 78 that are laterally aligned with the holes 104 in the subframe 58; and 3) a bolt 114 inserted into the slots 102 so as to extend into hole 104. Nuts 105 and washers are installed as shown (FIG. 6) to secure the beam's lateral position with respect to the subframe 58, as shown in FIGS. 7 and 8. The vertical slots 102 in the beam 78 (FIG. 4) permit beam 78 to be raised and lowered, as desired, during operation of the clamping mechanism 74, as shown in FIGS. 7 and 8. In this manner, lateral movement of the clamping mechanism 74 is fixed with respect to the subframe 58.

It must be further noted that while a clamping mechanism 74 in accordance with the preferred embodiment has been described, any clamping device that can be loosened to permit the easy removal of the electrical heating element without removal of the screed plate 46 may be used.

Figure 9:
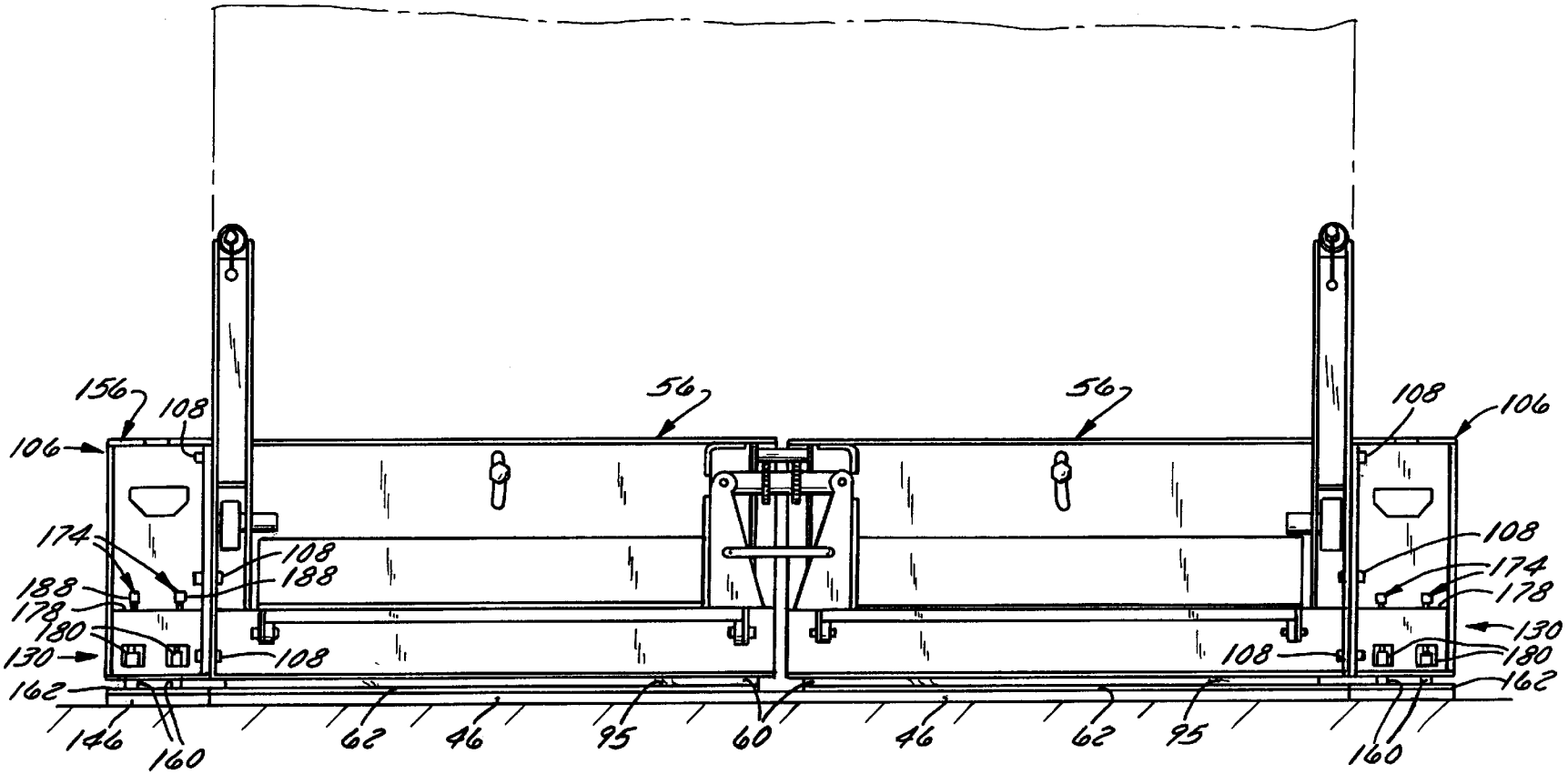
FIG. 9 is a rear elevation view showing the two halves of the screed plate of the screed assembly, on a slightly reduced scale relative to FIG. 3.
Figure 10:
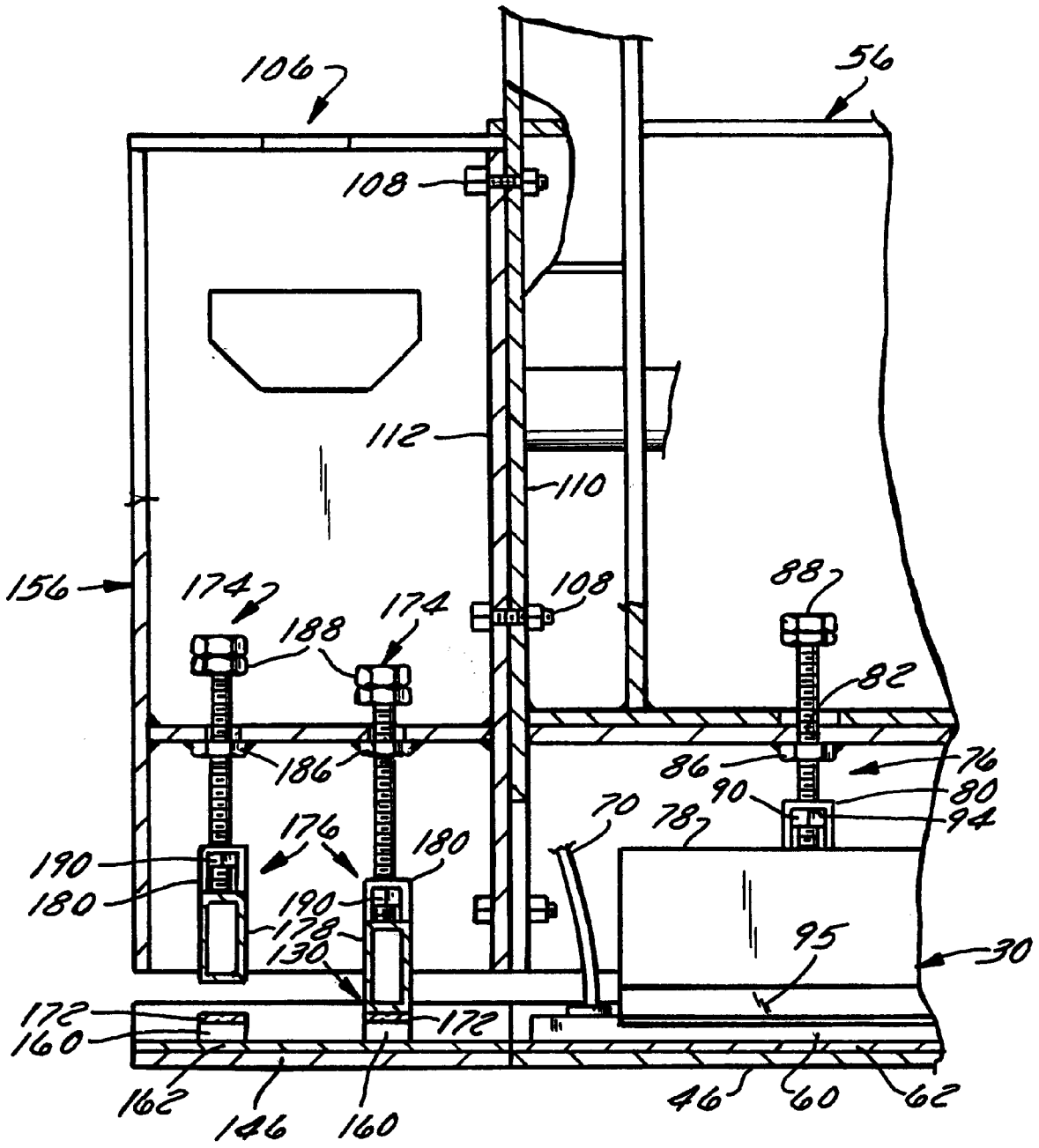
FIG. 10 is a fragmentary sectional side elevation view showing an extension mounted onto the screed assembly, on an enlarged scale relative to FIG. 9.
Figure 11:
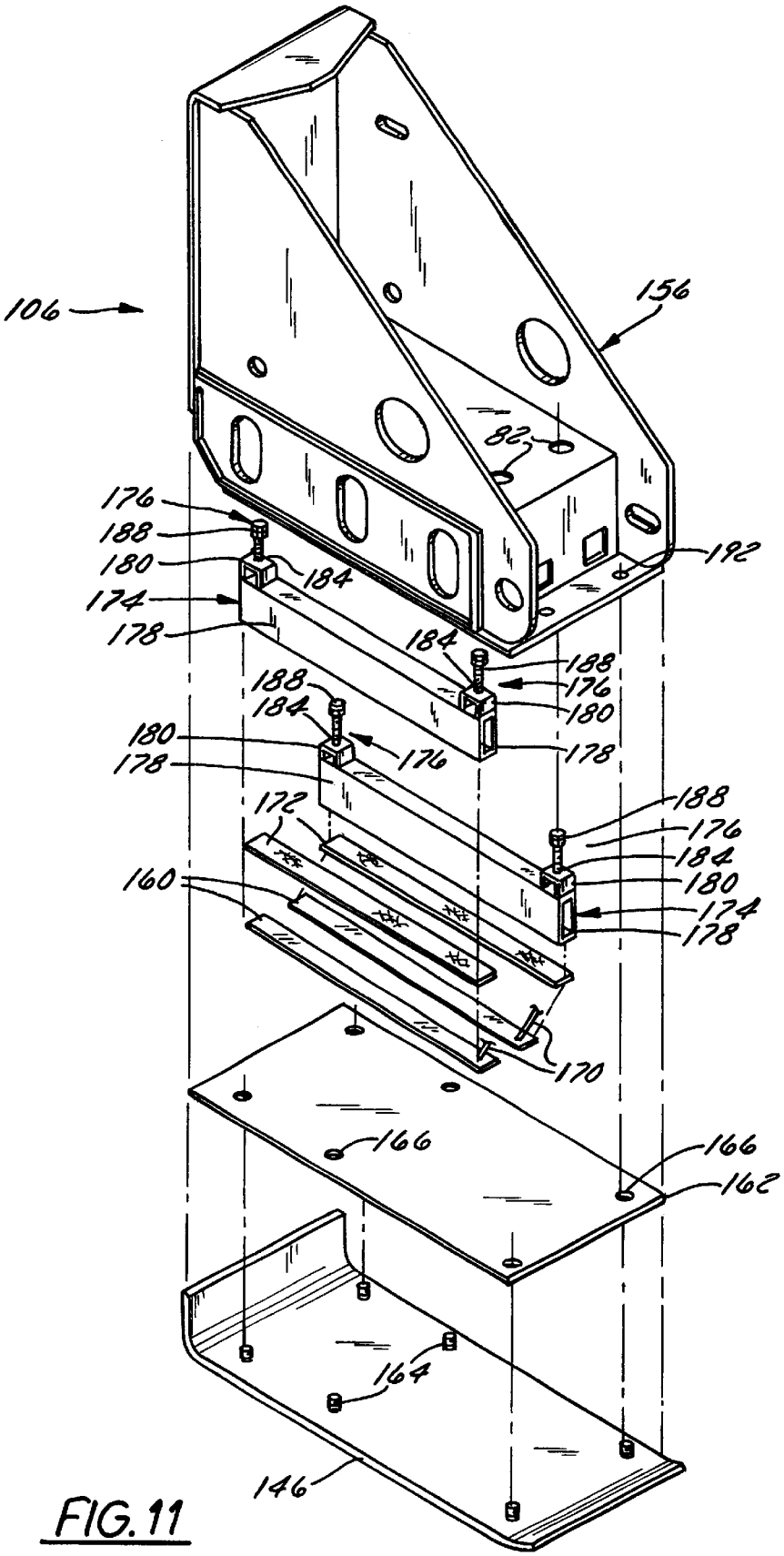
FIG. 11 is an exploded perspective view of the extension.

Turning now to FIGS. 9, 10, and 11, a lateral extension component 106 having an electrically heated screed assembly 130 (FIGS. 9 and 10) is shown connected to the above-described screed assembly 30 by bolts 108 (FIG. 9) extending though holes in a side wall 110 (FIG. 10) of main frame 56 and through mating holes in a corresponding side wall 112 of frame member 156 of extension 106. The extension 106 is particularly useful when a wider surface area than normal is to be paved. Extension 106 comprises a screed plate 146 with studs 164 (FIG. 11) extending through holes 166 in a conductive plate 162 that are fixed to holes 192 in the frame 156. Electrical heating elements 160 and insulation layers 172 are positioned above the thermally conductive plate 162. The extension 106 is shown further to include two clamping mechanisms 174 (FIG. 9), one of which is provided for each heating element 160. Each clamping mechanism 174 (FIG. 11) includes a beam 178 and two clamps 176. An alternative embodiment may further include a bent plate (not shown), as previously described above in connection with FIGS. 2, 4 and 6–8. Each illustrated clamp 176 (FIGS. 10 and 11) is seen to include bolts 188, brackets 180, and nuts 190. Also as mentioned above, bolts 188 can threadedly engage threaded holes in the frame 156, or may threadedly engage nuts 186. As shown in FIG. 10, the clamping mechanism 174 on the left is loose while the clamping mechanism 174 on the right is tightened, as previously described. However, in the extension 106, the clamping mechanism 174 and heating elements 160 extend laterally of the above-described screed assembly 30. Note also that the heating elements 160 and clamping mechanisms 174 are sufficiently short that pusher bolts (none shown) are accordingly not needed to ensure that the heating elements 160 are sufficiently compressed, nor are lateral clamps necessary.

A method of assembling the screed assembly 30 will now be described. First, the clamping mechanism is assembled as follows. Such assembly includes positioning the subframe 58 and brackets 80 in a manner such that their respective holes 82 and 84 are aligned, and securing the brackets 80 to subframe 58 using bolts 88 and nuts 90, as shown in FIG. 7. Next, the conductive plate is placed on top of the screed plate 46, as shown in FIG. 3. Then, with the conductive plate 62 on screed plate 46 (as shown in FIG. 7), with the heating elements 60 placed on the top of conductive plate 62 in spaced-apart fashion (see, e.g., FIGS. 5 and 7), and with insulation layers 72 longitudinally placed on top of corresponding associated heating elements 60 (see, e.g., FIGS. 6 and 7), the clamping bar portion of the clamping mechanism 74 is sub-assembled by first aligning bolts 114 with opposite slots 102 through beam 78, then passing the bolts 114 through the holes 102, and using nuts 105 and washers (as shown in FIG. 6) in a known manner, to position the plural (or several) tubular beams 78 (shown in FIG. 5) onto subframe 58 relative to the insulation layers 72 mounted on the heating elements 60 that have been placed on plate 62, as shown in FIG. 7. Next, the heating elements 60 with insulation layers 72 on top are together laterally slid inwardly, as can be appreciated by referring to FIG. 8. Finally, the several bolts 88 are separately rotated about their longitudinal axes in a known manner relative to subframe 58, to cause the tubular beam 78 to move toward the screed plate 46. The several heating elements 60 and corresponding supermounted insulation layers 72 are separately longitudinally aligned with the bent plate 95 of each respective tubular beam 78 (see, e.g., FIG. 6) before each tubular member 78 is brought into abutting engagement with a respective insulation layer 72, for purposes of fixedly urging the insulation layer against conductive plate 62, as shown in FIG. 7. While the longitudinal axes of bolts 88 are preferably disposed perpendicular to upper horizontal surface of subframe 58, those skilled in the art can appreciate that bolt orientation that is somewhat offset from the perpendicular may, on occasion, be desirable for certain design purposes. Such bolt orientation is within the scope of the present invention.

To remove an electrical heating element 60, the associated pusher bolts 96 are first loosened, and the bolts 88 of the two clamps 76 are also then loosened to raise the beam 78. The electrical heating element 60 to be replaced or repaired is then removed by sliding it longitudinally out of the screed assembly 30. A second heating element may then be inserted into the assembly 30 by sliding it in longitudinally above the thermally conductive plate 62. If necessary, the insulation layer 72 may be placed on top of the replacement heating element before insertion. Once the new heating element 60 is in place, the clamping mechanism 74 is tightened to lower the beam 78 onto the heating element 60, thus rendering the system operational. Note that replacement of the heating element 60 takes place without removal of the screed plate 46.

Many changes and modifications may be made to the invention without departing from the spirit thereof. The scope of these changes will become apparent from the appended claims.

I claim:

1. An electrically heated screed assembly for use with a paving machine, comprising:

a screed plate;

a conductive plate disposed above and in thermal communication with the screed plate;

an electrical heating element disposed above and in thermal communication with the conductive plate; and a clamping mechanism that is positioned over the heating element and that is loosenable to permit removal of the heating element from the screed assembly and tightenable to clamp the heating element to the conductive plate and to prevent removal of the heating element from the screed assembly.

2. The assembly of claim 1, wherein the clamping mechanism comprises a beam disposed above the heating element and a bolt above and perpendicular to the beam, wherein turning the bolt in a first direction raises the beam away from the heating element, and turning the bolt in a second opposite direction lowers the beam towards the heating element, thus permitting easy removal and insertion of the heating element.

3. The assembly of claim 2, wherein the clamping mechanism further comprises:

a subframe having an upper horizontal surface, the surface having a first vertical hole extending therethrough;

a bracket mounted on top of the beam, the bracket having a second vertical hole aligned with the first hole;

a first nut affixed to the bolt below the second vertical hole;

wherein the first hole through the upper horizontal surface includes threads that threadedly engage the bolt and insertion of the bolt into the first and second holes permits the beam to be raised when the bolt is loosened, and lowered when the bolt is tightened.

4. The assembly of claim 3, further comprising a second clamp that restrains the beam from lateral movement relative to the first vertical surface.

5. The assembly of claim 4, wherein the beam includes first and second vertical surfaces, the subframe includes a third vertical surface, the second clamp further comprising:

first and second aligned vertical slots in the first and second vertical surfaces respectively;

a hole in the third vertical surface; and a bolt extending though the first and second slots and into the hole to permit raising and lowering of the beam while minimizing lateral movement of the beam.

6. The assembly of claim 2, further comprises an insulating element disposed between the heating element and the beam.

7. The assembly of claim 6, wherein the heating element includes a rigid metallic bar.

8. An electrically heated screed assembly for use with a paving machine, comprising:

a screed plate;

a thermally conductive plate disposed above and in direct contact with the screed plate; and an electrical heating element disposed above and in direct contact with said thermally conductive plate, wherein heating the heating element heats the thermally conductive plate, thus uniformly heating the screed plate.

9. The assembly of claim 8, wherein the heating element is made of a metallic material.

10. The assembly of claim 8, further comprising a clamping mechanism that is loosenable to permit removal of the heating element and tightenable to clamp the heating element to the conductive plate and to prevent removal of the heating element from the assembly.

11. The assembly of claim 10, further comprising an insulating clement disposed above the heating element.

12. An electrically heated screed assembly for use with a paving machine comprising:

a frame;

a screed plate mounted on the frame;

an electrical heating element disposed above the screed plate; and a clamping mechanism including a beam that is movably and selectively and adjustably mounted on the frame so as to be selectively:

(1) lowered towards the screed plate so as to compress the electrical heating element against an underlying support and to prevent removal of the heating element from the screed assembly; and (2) raised away from the heating element to permit removal of the heating element from the screed assembly.

13. The assembly of claim 12, wherein the assembly further comprises an insulating layer disposed between the heating element and the selectively adjustable beam of the clamping mechanism.

14. The assembly of claim 12, wherein the clamping mechanism further comprises:

a threaded fastener;

a subframe having an upper horizontal surface, the surface having a first vertical hole extending through the surface, wherein the first hole has threads that threadedly engage the threaded fastener; and said beam disposed above the heating element and below the upper horizontal surface.

15. The assembly of claim 14, wherein the threaded fastener is a bolt that threadedly engages the threads of the first hole.

16. The assembly of claim 15, wherein the clamping mechanism further comprises:

a bracket mounted on top of the beam, the bracket having a second vertical hole aligned with the first vertical hole;

a nut affixed to the bolt below the second vertical hole;

whereby insertion of the bolt into the first and second vertical holes enables the beam to be raised when the bolt is turned in a first direction, and lowered when the bolt is turned in a second direction opposite the first direction.

17. A paving machine comprising:

a chassis having a front end portion and a rear end portion;

a distributing auger mounted on the rear end portion of the chassis and extending transversely across the chassis;

a hopper mounted on the front end portion of the chassis and having a discharge opening;

a conveyor which transports the paving materials to the auger from the discharge opening; and an electrically heated screed assembly including:

a screed plate mounted on a subframe of the paving machine;

a conductive plate disposed above and in thermal communication with the screed plate;

an electrical heating element disposed above and in thermal communication with the conductive plate; and a clamp that is loosenable to permit removal of the heating element from the screed assembly and tightenable to clamp the heating element to the conductive plate and to prevent removal of the heating element from the screed assembly.

18. A method comprising the steps of:

(A) providing a paving machine having an electrically heated screed assembly including a screed plate;

(B) clamping an electrical heating element above the screed plate using a clamping mechanism;

(C) placing a thermally conductive plate between the screed plate and the electrical heating element prior to the clamping step; and (D) loosening the clamping mechanism to release the heating element from the screed assembly.

19. The method of claim 18, further comprising the step of mounting a heated screed assembly extension onto the heated screed assembly.

20. The method of claim 18, further comprising the step of removing the heating element in a generally longitudinal direction of the heating element after the clamping mechanism is loosened.

21. The method of claim 18, further comprising the steps of:

providing a subframe having a first vertical surface; and tightening a lateral clamp to restrain the clamping mechanism from lateral movement with respect to the subframe.

22. The method of claim 18, further comprising the step of inserting an insulator between the clamping mechanism and the heating element.

23. The method of claim 18, further comprising:

providing a subframe having a first horizontal surface and forming a first vertical hole in the first horizontal surface;

mounting a first nut on the first horizontal surface below the first vertical hole;

positioning a beam of the clamping mechanism above the electrical heating element and below the subframe;

mounting a bracket of the clamping mechanism onto the top of the beam, the bracket having a second horizontal surface;

forming a second vertical hole in the second horizontal surface that is vertically aligned with the first vertical hole, wherein the clamping step comprises inserting a bolt in the first and second holes such that tightening the bolt imposes a downward force on the clamping mechanism and the heating element.

24. The method of claim 23, further comprising the step of:

mounting a second nut on the bolt at a point below the second hole, and whereby the loosening step comprises loosening the bolt to cause the second nut to exert an upward force on the clamping mechanism.

25. A method of replacing a heating element in a heated screed assembly including a subframe, the method comprising the steps of:

providing a screed plate connected to the subframe;

providing a conductive plate positioned above the screed plate;

providing an electrical heating element disposed above the thermally conductive plate;

providing an insulating element positioned above the heating element;

loosening a clamping mechanism to remove compression from the heating element; and removing the heating element from the screed assembly without removing the screed plate from the frame.

26. The method of claim 25, further comprising removing the heating element in a generally longitudinal direction of the heating element when the clamping mechanism is loosened.

27. The method of claim 26, further comprising the steps of:

inserting a second electrical heating element longitudinally into the assembly above the conductive plate; and tightening the clamping mechanism to compress the heating element against the conductive plate.

* * * * *